US011651737B2

(12) United States Patent
Wang et al.

(10) Patent No.: US 11,651,737 B2
(45) Date of Patent: May 16, 2023

(54) CIRCUIT AND METHOD FOR DRIVING PIXEL

(71) Applicant: BOE TECHNOLOGY GROUP CO., LTD., Beijing (CN)

(72) Inventors: Tieshi Wang, Beijing (CN); Xueling Gao, Beijing (CN); Zhiqiang Xu, Beijing (CN); Chengchung Yang, Beijing (CN); Haoran Liu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/726,875

(22) Filed: Apr. 22, 2022

(65) Prior Publication Data

US 2022/0246098 A1 Aug. 4, 2022

Related U.S. Application Data

(63) Continuation of application No. 17/234,873, filed on Apr. 20, 2021, now Pat. No. 11,341,918, which is a (Continued)

(30) Foreign Application Priority Data

Nov. 15, 2018 (CN) ..... 201811357575.3

(51) Int. Cl.
*G09G 3/3258* (2016.01)
*G09G 3/3233* (2016.01)
*G09G 3/3266* (2016.01)

(52) U.S. Cl.
CPC ..... *G09G 3/3258* (2013.01); *G09G 3/3233* (2013.01); *G09G 3/3266* (2013.01)

(58) Field of Classification Search
CPC ..... G09G 3/3258; G09G 3/3233; G09G 3/3266
See application file for complete search history.

(56) References Cited

U.S. PATENT DOCUMENTS 10,249,238 B2 4/2019 Ko et al.
10,431,153 B2 * 10/2019 Gao ..... G09G 3/3225
(Continued)

FOREIGN PATENT DOCUMENTS

CN 107316606 A 11/2017
CN 107358917 A 11/2017
(Continued)

OTHER PUBLICATIONS

Office action from Chinese Application No. 201811357575.3 dated Dec. 31, 2019.
(Continued)

*Primary Examiner* — Sardis F Azongha
(74) *Attorney, Agent, or Firm* — Calfee, Halter & Griswold LLP

(57) ABSTRACT

A circuit for driving a pixel includes a driving transistor having a first end connected to a first node, a control end connected to a second node, and a second end connected to a third node; a writing circuit connected to a first scanning signal and the first node and configured to transmit a data signal to the first node; a reset circuit connected to a second scanning signal and configured to transmit a reference signal to the second node; a compensation circuit connected to a compensation control signal and configured to put through a connection between the second end and the control end of the driving transistor in response to the compensation control signal, wherein the compensation control signal is different from the first scanning signal and the second scanning signal; and an energy storage circuit connected between a first power end and the second node.

9 Claims, 5 Drawing Sheets

Related U.S. Application Data continuation of application No. 16/456,910, filed on Jun. 28, 2019, now Pat. No. 10,991,306.

(56) References Cited

U.S. PATENT DOCUMENTS

| | | | | |
|---|---|---|---|---|
| 10,460,673 | B2 * | 10/2019 | Gao | H01L 29/78645 |
| 10,565,422 | B2 * | 2/2020 | Zhou | G06V 40/1318 |
| 10,755,635 | B2 | 8/2020 | Yang et al. | |
| 2012/0001893 | A1 | 1/2012 | Jeong et al. | |
| 2015/0187270 | A1 | 7/2015 | Lee et al. | |
| 2016/0321990 | A1 | 11/2016 | Kim et al. | |
| 2018/0130424 | A1 | 5/2018 | Gao et al. | |
| 2018/0144681 | A1 | 5/2018 | Xiang et al. | |
| 2018/0151123 | A1 | 5/2018 | Li et al. | |
| 2018/0158417 | A1 | 6/2018 | Xiang et al. | |
| 2018/0166025 | A1 | 6/2018 | Zhou et al. | |

FOREIGN PATENT DOCUMENTS

| | | | |
|---|---|---|---|
| CN | 107452331 | A | 12/2017 |
| CN | 107767819 | A | 3/2018 |
| CN | 108230982 | A | 6/2018 |
| KR | 20180102733 | A | 9/2018 |

OTHER PUBLICATIONS

Office action from Chinese Application No. 201811357575.3 dated Sep. 9, 2020.

Office action from Chinese Application No. 201811357575.3 dated Dec. 25, 2020.

Office action from U.S. Appl. No. 16/456,910 dated May 8, 2020.

Office action from U.S. Appl. No. 16/456,910 dated Oct. 20, 2020.

Office action from U.S. Appl. No. 17/234,873 dated Sep. 14, 2021.

* cited by examiner

CIRCUIT AND METHOD FOR DRIVING PIXEL

CROSS-REFERENCE TO RELATED APPLICATIONS

This application is a continuation of U.S. patent application Ser. No. 17/234,873 entitled "METHOD OF DRIVING PIXEL," filed Apr. 20, 2021, which is a continuation of U.S. patent application Ser. No. 16/456,910 entitled "CIRCUIT OF DRIVING PIXEL, METHOD OF DRIVING PIXEL AND DISPLAY DEVICE USING THE SAME," filed Jun. 28, 2019, which is based upon and claims priority to Chinese Patent Application No. 201811357575.3, filed on Nov. 15, 2018, the contents of which being incorporated by reference in their entireties herein.

TECHNICAL FIELD

The present disclosure relates to the field of display technology and, particularly, to a circuit for driving pixel, a method for driving pixel, and a display device using the same.

BACKGROUND

With the development and advancement of technology, AMOLED (Active Matrix Driving OLED) is widely used in various display devices. In AMOLED technology, each OLED is driven by a TFT (Thin Film Transistor) switching circuit scanning and inputting current line by line.

In related art, due to hysteresis effect of TFT, a current of a light emitting element is not only related to a bias voltage of the TFT at present but also related to a bias voltage of the TFT at the last moment, which may lead to short-term afterimage phenomenon when it is switched between images with different gray levels, then affecting display effect of the display device.

It should be understood that information disclosed in the background section above is only for enhancing the comprehension of the background of the present disclosure, and thus may include information that does not constitute prior art known to those ordinary skilled in the art.

SUMMARY

According to a first aspect of the present disclosure, a circuit for driving a pixel is provided. The circuit for driving the pixel includes:

a driving transistor having a first end connected to a first node, a control end connected to a second node, and a second end connected to a third node;

a writing circuit connected to a first scanning signal and the first node and configured to transmit a data signal to the first node;

a first control circuit connected to a light emitting control signal and configured to transmit a first voltage signal to the first node;

a reset circuit connected to a second scanning signal and configured to transmit a reference signal to the second node;

a compensation circuit connected to a compensation control signal and configured to put through a connection between the second end and the control end of the driving transistor in response to the compensation control signal, wherein the compensation control signal is different from the first scanning signal and the second scanning signal;

a second control circuit connected to the light emitting control signal and configured to transmit a signal of the third node to a first end of a light emitting element, wherein a second end of the light emitting element is connected to a second voltage signal; and an energy storage circuit connected between a first power end and the second node.

According to an arrangement of the present disclosure, the circuit for driving the pixel further includes:

an initialization circuit connected to a reference signal end and configured to initialize the first end of the light emitting element.

According to an arrangement of the present disclosure, the writing circuit includes a first switching element having a control end connected to a first scanning end, a first end connected to a data signal end, and a second end connected to the first node;

the first control circuit includes a second switching element having a control end connected to a light emitting control end, a first end connected to the first power end, and a second end connected to the first node;

the reset circuit includes a third switching element having a control end connected to a second scanning end, a first end connected to a reference signal end, and a second end connected to the second node;

the compensation circuit includes a fourth switching element having a control end connected to a compensation control signal end, a first end connected to the second end of the driving transistor, and a second end connected to the second node; and the second control circuit includes a fifth switching element having a control end connected to the light emitting control end, a first end connected to the third node, and a second end connected to the first end of the light emitting element.

According to a second aspect of the present disclosure, a method of driving a pixel is provided. The method is applied to a circuit for driving the pixel, and includes:

providing a driving transistor having a first end connected to a first node, a control end connected to a second node, and a second end connected to a third node;

providing a writing circuit connected to a first scanning signal and the first node and configured to transmit a data signal to the first node;

providing a first control circuit connected to a light emitting control signal and configured to transmit a first voltage signal to the first node;

providing a reset circuit connected to a second scanning signal and configured to transmit a reference signal to the second node;

providing a compensation circuit connected to a compensation control signal and configured to put through a connection between the second end and the control end of the driving transistor in response to the compensation control signal, wherein the compensation control signal is different from the first scanning signal and the second scanning signal;

providing a second control circuit connected to the light emitting control signal and configured to transmit a signal of the third node to a first end of a light emitting element, wherein a second end of the light emitting element is connected to a second voltage signal;

providing an energy storage circuit connected between a first power end and the second node;

controlling to turn on the reset circuit and the compensation circuit and turn off the writing circuit, the first control circuit, and the second control circuit, so as to make the driving transistor in a bias state;

controlling to turn on the writing circuit and the compensation circuit and turn off the first control circuit and the reset circuit, so as to write the data signal and a threshold voltage of the driving transistor to an energy storage circuit; and controlling to turn on the first control circuit and the second control circuit and turn off the writing circuit, the reset circuit, and the compensation circuit, so as to control the driving transistor to be turned on by the energy storage circuit to drive a light emitting element to emit light.

According to an arrangement of the present disclosure, the method of driving pixel further includes turning on an initialization circuit, so as to initialize the first end of the light emitting element.

According to an arrangement of the present disclosure, the writing circuit includes a first switching element having a control end connected to a first scanning end, a first end connected to a data signal end, and a second end connected to the first node;

the first control circuit includes a second switching element having a control end connected to a light emitting control end, a first end connected to the first power end, and a second end connected to the first node;

the reset circuit includes a third switching element having a control end connected to a second scanning end, a first end connected to a reference signal end, and a second end connected to the second node;

the compensation circuit includes a fourth switching element having a control end connected to a compensation control signal end, a first end connected to the second end of the driving transistor, and a second end connected to the second node; and the second control circuit includes a fifth switching element, a control end connected to the light emitting control end, a first end connected to the third node, and a second end connected to the first end of the light emitting element, wherein the controlling to turn on the reset circuit and the compensation circuit and turn off the writing circuit, the first control circuit and the second control circuit, to make the driving transistor in the bias state, includes:

the third switching element receiving the second scanning signal to turn on the third switching element, and transmitting the reference signal to the second node; and the fourth switching element receiving the compensation control signal to turn on the fourth switching element, and putting through the connection between the second end and the control end of the driving transistor; and the controlling to turn on the writing circuit and the compensation circuit and turn off the first control circuit, the reset circuit and the second control circuit, to write the data signal and the threshold voltage of the driving transistor to the energy storage circuit, includes:

the first switching element receiving the first scanning signal to turn on the first switching element, and transmitting the data signal to the first node; turning on the driving transistor under control of the energy storage circuit; and the fourth switching element receiving the compensation control signal to be turned on to compensate the driving transistor.

According to an arrangement of the present disclosure, the controlling to turn on the reset circuit and the compensation circuit and turn off the writing circuit, the first control circuit, and the second control circuit includes making the driving transistor change to the bias sate using the first scanning signal, the light emitting control signal, the second scanning signal, and the compensation control signal, and a potential of the control end of the driving transistor is Vint, a potential of the first end of the driving transistor becomes Vint minus Vth, and Vth is the threshold voltage of the driving transistor.

According to an arrangement of the present disclosure, the controlling to turn on the writing circuit and the compensation circuit and turn off the first control circuit, the reset circuit, and the second control circuit includes using the first scanning signal, the light emitting control signal, the second scanning signal, and the compensation control signal to write the data signal and the threshold voltage of the driving transistor to the energy storage circuit; and a potential of the first node is Vdata, and a potential of the second node is Vdata plus Vth, and Vth is the threshold voltage of the driving transistor.

It should be understood that the above general description and the following detailed description are merely exemplary and explanatory, which cannot limit to the present disclosure.

BRIEF DESCRIPTION OF THE DRAWINGS

The accompanying drawings, which are incorporated in the specification and constitute a part of the specification, show the arrangements in compliance with the present disclosure, and are used to interpret the principle of the present disclosure together with the description. It is understood that the drawings in the following description are only some arrangements of the present disclosure, from which, other drawings may be obtained by those ordinary skilled in the art without paying any creative effort.

DETAILED DESCRIPTION

Figure 1:
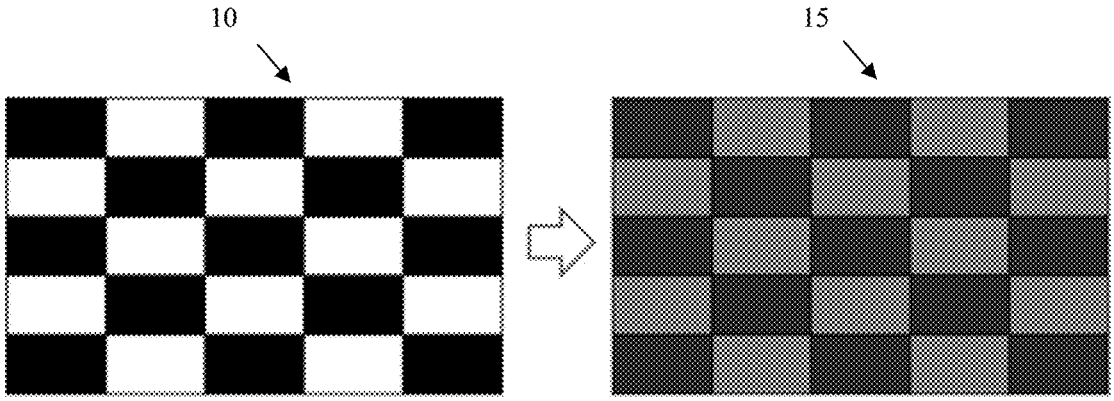
FIG. 1 is a schematic diagram of the generation of afterimage when a checkerboard image is switching to a low gray level, provided in the related art.

Exemplary arrangements will now be described more fully with reference to the accompanying drawings. However, the exemplary arrangements can be embodied in a variety of forms, and should not be construed as limited in the examples set forth herein. On the contrary, these arrangements are provided so that this disclosure will be more comprehensive and complete, and the concept of the exemplary arrangements may be fully conveyed to those skilled in the art. The described features, structures, or characteristics may be combined in one or more arrangements in any suitable manner. In the following description, numerous specific details are provided for thorough comprehension to the arrangements of the present disclosure. However, those skilled in the art will appreciate that the technical solutions of the present disclosure can be implemented even one or more of specific details may be omitted, or by adopting other methods, elements, devices, blocks, etc. In other cases, well-known technical solutions are not shown or described in detail so as to avoid obscuring the respective aspects of the present disclosure.

In addition, the accompanying drawings are merely schematic representations of the present disclosure and are not necessarily drawn to scale. The same reference numerals in the drawings represent the same or similar parts, so the repeated description thereof will be omitted. Some of block diagrams shown in the accompanying drawings are functional entities and do not necessarily have to correspond to physical or logical separate entities. These functional entities may be implemented in software, or implemented in one or more hardware circuits or integrated circuits, or implemented in different network and/or processor devices and/or microcontroller devices.

In related art, due to hysteresis effect of TFT, a current of a light emitting element is not only related to a bias voltage of the TFT at present but also related to a bias voltage of the TFT at the last moment, which may lead to short-term afterimage phenomenon when it is switched between images with different gray levels. For example, as shown in FIG. 1, an afterimage 15 is generated when a checkerboard image is switched to a low gray level.

Figure 2:
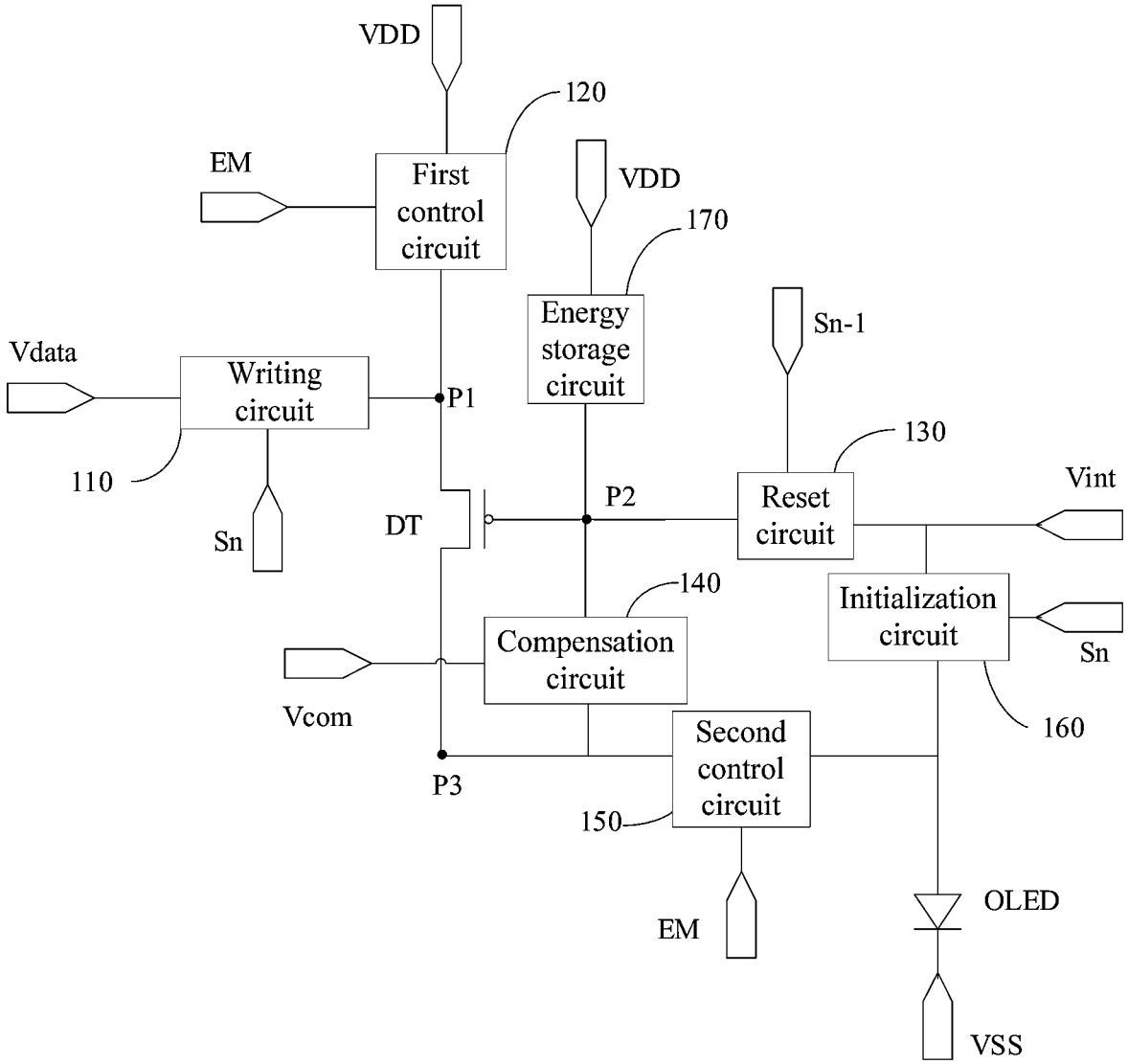
FIG. 2 is a schematic diagram of a circuit of driving pixel provided by an exemplary arrangement of the present disclosure.

At first, the exemplary arrangement provides a circuit of driving pixel. As shown in FIG. 2, the circuit of driving pixel includes a driving transistor DT, having a first end connected to a first node P1, a control end connected to a second node P2, and a second end connected to a third node P3. The circuit of driving pixel includes a writing circuit 110, connected to a data signal end Vdata, a first scanning end Sn and the first node P1, and configured to transmit a data signal to the first node P1 under a control of a first scanning signal. The circuit of driving pixel includes a first control circuit 120, connected to a first power end VDD, a lighting control end EM and the first node P1, and configured to transmit a first voltage signal to the first node P1 under a control of a light emitting control signal. The circuit of driving pixel includes a reset circuit 130, connected to a reference signal end Vint, a second scanning end Sn−1 and the second node P2, and configured to transmit a reference signal to the second node P2 under a control of a second scanning signal. The circuit of driving pixel includes a compensation circuit 140, connected between the second node P2 and the third node P3, and configured to put through a connection between a second end and a control end of the driving transistor DT under a control of a compensation control signal. The circuit of driving pixel includes a second control circuit 150, connected to the third node P3, the light emitting element and the light emitting control end EM, and configured to transmit a signal of the third node P3 to a first end of a light emitting element under the control of the light emitting control signal. A second end of the light emitting element is connected to a second power end VSS, to receive the second voltage signal. The circuit of driving pixel includes an energy storage circuit 170, connected between the first power end VDD and the second node P2.

The circuit of driving pixel provided by arrangements of the present disclosure controls to turn on the reset circuit and the compensation circuit and turn off the writing circuit, the first control circuit and the second control circuit by the first scanning signal, the light emitting control signal, the second scanning signal and the compensation control signal, so as to make the driving transistor in a bias state in a reset period; then, perform writing of the data signal and drive the light emitting element to emit light. Since a driving end of the driving transistor is in the bias state before the data signal of each frame of image has been written in, the phenomenon that the display device may generate an afterimage, caused due to TFT hysteresis phenomenon, i.e., a current of a light emitting element is not only related to a bias voltage of the TFT for the present frame but also related to a bias voltage of the TFT for the last frame of image, can be avoided, which may improve display effect.

In an exemplary arrangement, the light emitting element may be a current-driven type light emitting element, which is controlled to emit light by a current flowing through the driving transistor DT.

Further, in order to perform initialization processing on the light emitting element, the circuit of driving pixel further includes: an initialization circuit 160, connected to the first scanning end Sn, the reference signal end Vint and the first end of the light emitting element, and configured to transmit the reference signal to the first end of the light emitting element under the control of the first scanning signal.

Figure 3:
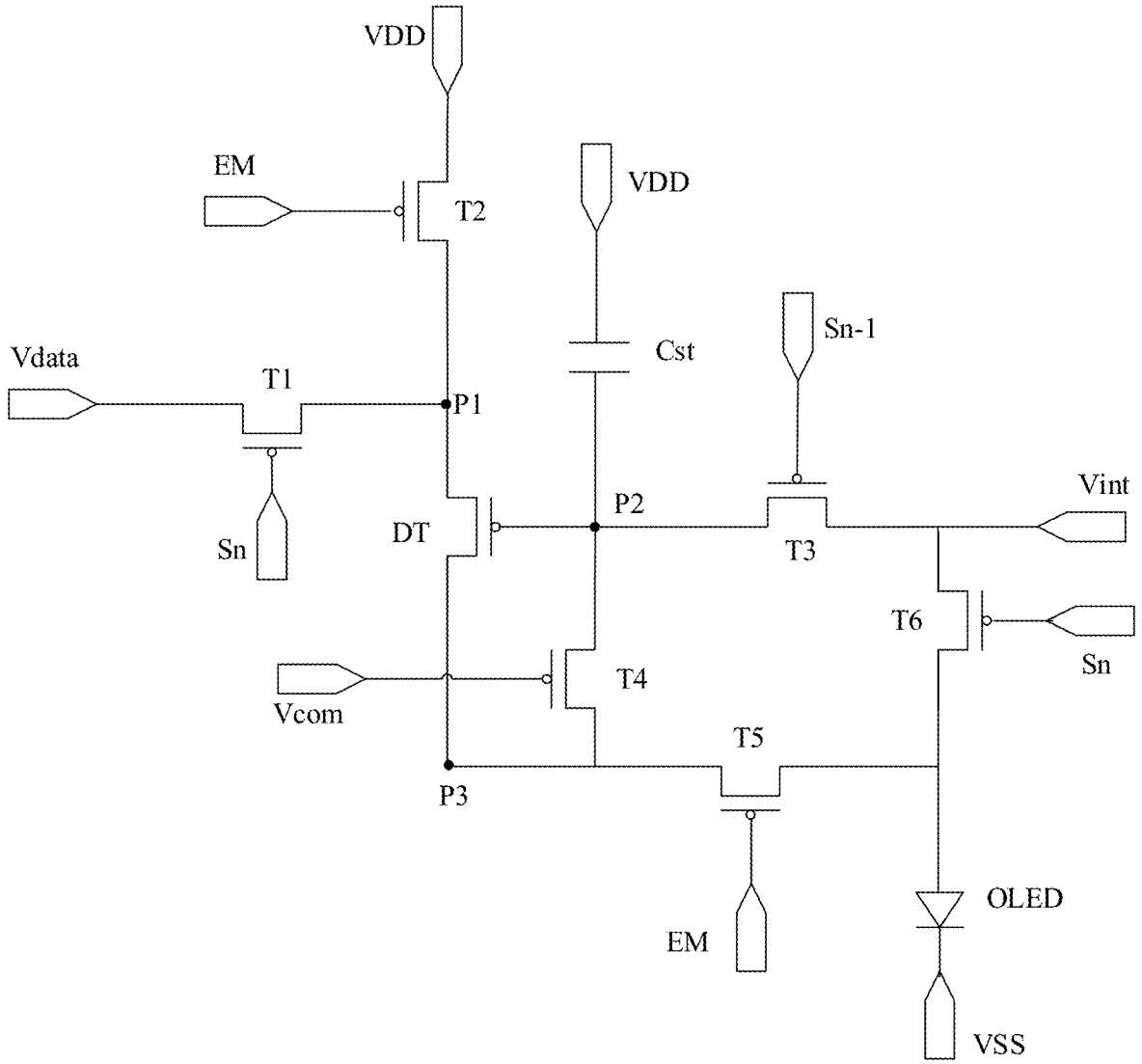
FIG. 3 is a schematic diagram of another circuit of driving pixel provided by an exemplary arrangement of the present disclosure.

Each circuit in the arrangement of the present disclosure will be described in detail below with reference to FIG. 3.

The writing circuit 110 includes: a first switching element having a control end connected to the first scanning end Sn, a first end connected to the data signal end Vdata, and a second end connected to the first node P1.

The first control circuit 120 includes: a second switching element having a control end connected to the light emitting control end EM, a first end connected to the first power end VDD, and a second end connected to the first node P1.

The reset circuit 130 includes: a third switching element having a control end connected to the second scanning end Sn−1, a first end connected to the reference signal end Vint, and a second end connected to the second node P2.

The compensation circuit 140 includes: a fourth switching element having a control end connected to a compensation control signal end Vcom, a first end connected to the second end of the driving transistor DT, and a second end connected to the second node P2.

The second control circuit 150 includes: a fifth switching element having a control end connected to the light emitting control end EM, a first end connected to the third node P3, and a second end connected to the first end of the light emitting element.

The initialization circuit 160 includes: a sixth switching element having a control end connected to the first scanning end Sn, a first end connected to the reference signal end Vint, and a second end connected to the light emitting element.

A turning-on level of the second scanning signal is preceding to a turning-on level of the first scanning signal.

In the exemplary arrangement, the first to sixth switching elements may correspond to the first to sixth transistors T1-T6, each of which has a control end, a first end and a second end respectively. Specifically, the control end of each transistor may be a gate, the first end thereof may be a source, and the second end thereof may be a drain; or, the control end of each transistor may be a gate, the first end thereof may be a drain, and the second end thereof may be a source. In addition, each transistor may be an enhancement transistor or a depletion transistor, which is not limited in this exemplary arrangement.

In a possible implementation manner of the present disclosure, each of the switching elements is a P-type thin film transistor. The first voltage signal is a low level signal, the second voltage signal is a high level signal whose level is higher than that of the low level signal, the first end of the light emitting element is a cathode of a light emitting diode, and the second end of the light emitting element is an anode of the light emitting diode.

In a possible implementation manner of the present disclosure, each of the switching elements is an N-type thin film transistor. The first voltage signal is a high level signal, the second voltage signal is a low level signal whose level is lower than that of the high level signal, the first end of the light emitting element is an anode of a light emitting diode, and the second end of the light emitting element is a cathode of the light emitting diode.

As follows, taking all switching elements being P-type transistors and conducted at low level as an example, the connection relationship among the respective structures in the exemplary arrangement will be specifically described with reference to FIG. 3.

A first transistor T1 has a control end connected to the first scanning end Sn, and configured to receive the first scanning signal; a first end connected to the data signal end Vdata, and a second end connected to the first node P1.

A second transistor T2 has a control end connected to the light emitting control end EM, and configured to receive the light emitting control signal; a first end connected to the first power end VDD, and a second end connected to the first node P1.

A third transistor T3 has a control end connected to the second scanning end Sn−1, and configured to receive the second scanning signal; a first end connected to the reference signal end Vint; and a second end connected to the second node P2.

A fourth transistor T4 has a control end connected to the compensation control signal end Vcom, and configured to receive the compensation control signal; a first end connected to the second end of the driving transistor DT; and a second end connected to the second node P2.

A fifth transistor T5 has a control end connected to the light emitting control end EM, and configured to receive the light-emitting control signal; a first end connected to the third node P3; and a second end connected to the first end of the light emitting element.

A sixth transistor T6 has a control end connected to the first scanning end Sn, and configured to receive the first scanning signal; a first end connected to the reference signal end Vint; and a second end connected to the light emitting element.

Figure 4:
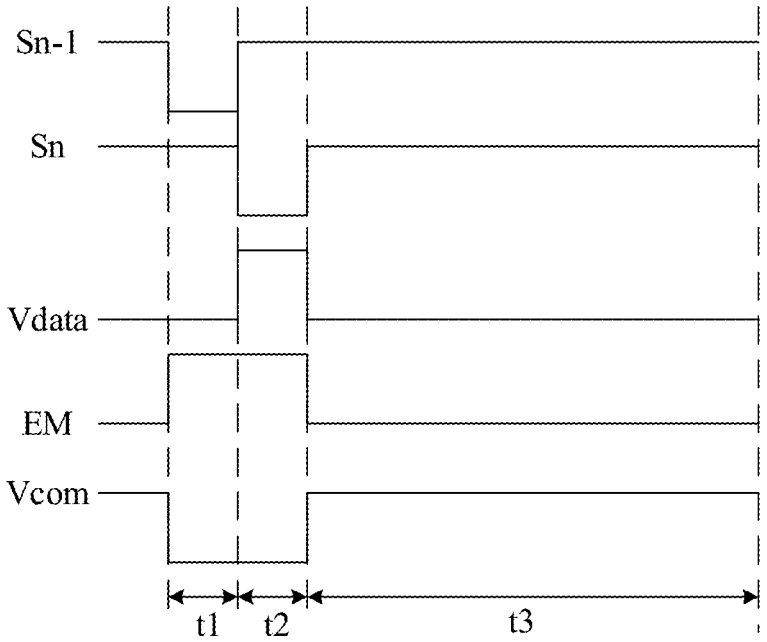
FIG. 4 is a control timing diagram of a circuit of driving pixel provided by an exemplary arrangement of the present disclosure.

The working process of the circuit of driving pixel will be specifically described with reference to the circuit of driving pixel shown in FIG. 3 and the control signal waveform diagram shown in FIG. 4. The first voltage signal is the low level signal, the second voltage signal is the high level signal. The light emitting element is a light emitting diode OLED, the first end of the light emitting element is a cathode of the OLED, the second end of the light emitting element is an anode of the OLED, and the energy storage circuit 170 is a storage capacitor Cst.

In a first period t1 (reset period), the second scanning signal and the compensation control signal are at a low level, the gate of the third transistor T3 receives the second scanning signal to turn on the third transistor T3, and transmit the reference signal of the reference signal end Vint to the second node P2, then the driving transistor DT is set to a bias state; the gate of the fourth transistor T4 receives the compensation control signal to turn on the fourth transistor T4, and put through a connection between the second end and the gate of the driving transistor DT; and the first transistor T1, the second transistor T2, the fifth transistor T5 and the sixth transistor T6 are turned off. At this time, a gate potential of the driving transistor DT is Vint, a source potential of the driving transistor DT becomes Vint minus Vth, and, then, the driving transistor DT is in a bias state and the storage capacitor Cst is charged. Therefore, whatever value of a driving data signal voltage of the last frame of image, when switching to and displaying the present frame of image, the driving transistor DT starts to write data and compensate it always from the bias state, such that the short-term afterimage problem caused by hysteresis effect may be solved. For example, as shown in FIG. 1, the last frame of image 10 displays a black and white checkerboard, and when switching the image, through the circuit of driving pixel provided by the arrangement of the present disclosure, the driving transistors DT corresponding to the black or white pixel regions may start to write data and compensate it from a bias state.

In a second period t2 (writing period), the first scanning signal and the compensation control signal are at a low level, the gate of the first transistor T1 receives the first scanning signal to turn on the first transistor T1, and transmit the data signal to the first node P1; the driving transistor DT is turned on under a control of the storage capacitor Cst; the fourth transistor T4 receives the compensation control signal to be turned on, and compensate the driving transistor DT; and the gate of the sixth transistor T6 receives the first scanning signal to turn on the sixth transistor T6, and transmit the reference signal to the first end of the light emitting element. The second transistor T2, the third transistor T3 and the fifth transistor T5 are turned off. At this time, the potential of the first node P1 is Vdata, and the potential of the second node P2 is Vdata plus Vth.

In a third stage t3 (lighting period), the light emitting control signal is at a low level, the gates of the second transistor T2 and the fifth transistor T5 receive the light emission control signal to turn on the second transistor T2 and the fifth transistor T5; and the driving transistor DT is turned on under a control of the storage capacitor Cst, then a driving current flows through the second transistor T2, the driving transistor DT and the fifth transistor T5 to drive the light emitting element to emit light.

It should be understood that, in the above specific arrangements, all the transistors are P-type transistors; however, those skilled in the art may easily obtain a circuit of driving pixel in which all transistors are N-type transistors according to the circuit of driving pixel provided by the present disclosure. In an exemplary arrangement of the present disclosure, all of the transistors may be N-type transistors, at this time, the first power signal VDD is the high level signal, the cathode of the OLED is connected to the fifth transistor T5, and the anode of the OLED is connected to the low level signal.

Figure 5:
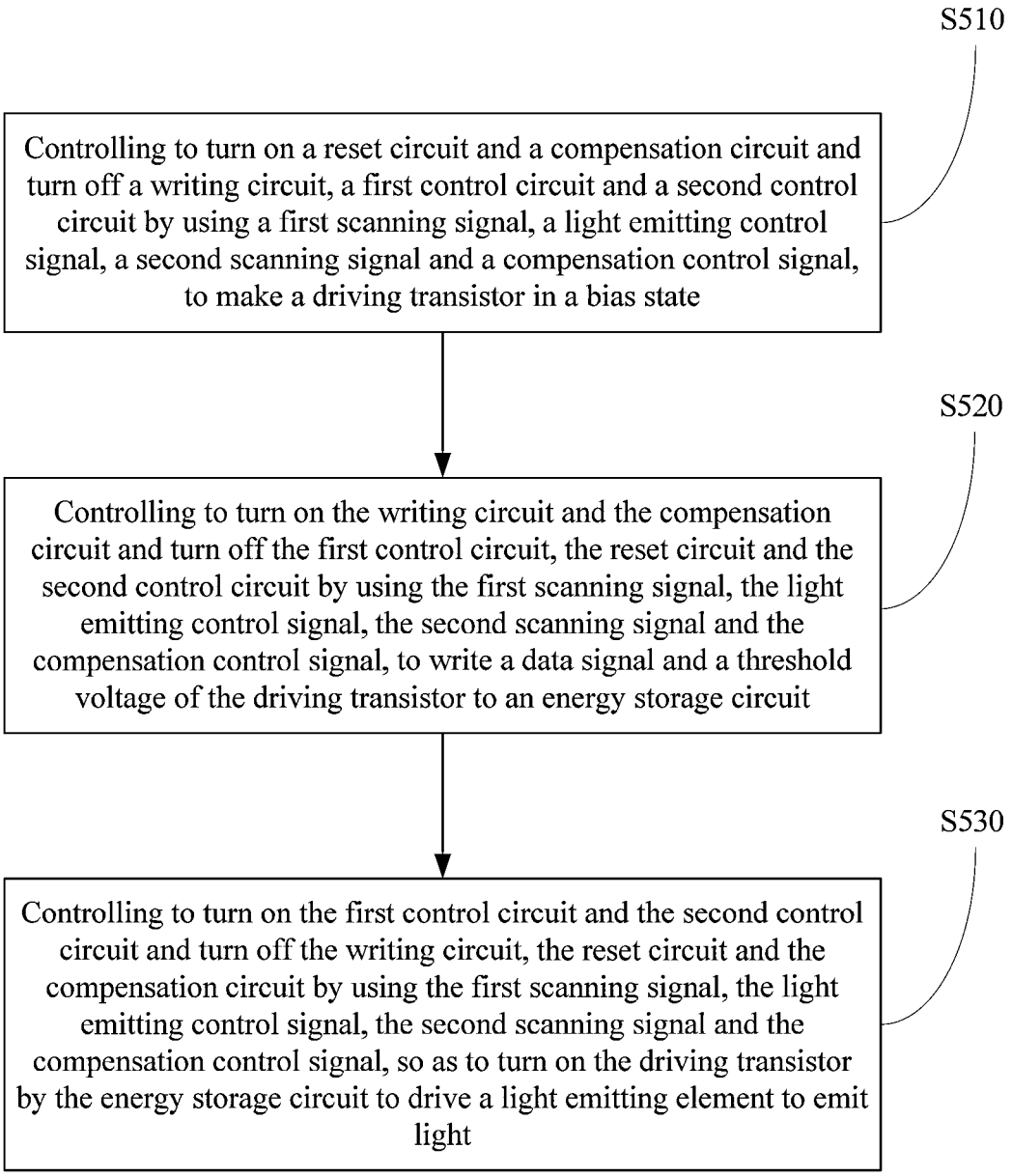
FIG. 5 is a flowchart of a method of driving pixel provided by an exemplary arrangement of the present disclosure.

An exemplary arrangement further provides a method of driving pixel. As shown in FIG. 5, the method of driving pixel may include following blocks.

In block S510, controlling to turn on a reset circuit and a compensation circuit and turn off a writing circuit, a first control circuit and a second control circuit using a first scanning signal, a light emitting control signal, a second scanning signal and a compensation control signal, to make a driving transistor in a bias state.

In block S520, controlling to turn on the writing circuit and the compensation circuit and turn off the first control circuit, the reset circuit and the second control circuit using the first scanning signal, the light emitting control signal, the second scanning signal and the compensation control signal, to write a data signal and a threshold voltage of the driving transistor to an energy storage circuit;

In block S530, controlling to turn on the first control circuit and the second control circuit and turn off the writing circuit, the reset circuit and the compensation circuit using the first scanning signal, the light emitting control signal, the second scanning signal and the compensation control signal, so as to turn on the driving transistor by the energy storage circuit to drive a light emitting element to emit light.

Further, the circuit of driving pixel includes an initialization circuit 160, and the block S520 further includes: turning on the initialization circuit using the first scanning signal, so as to transmit a reference signal to a first end of the light emitting element.

An exemplary arrangement further provides a display device including the circuit of driving pixel described above. The display device includes a plurality of scanning lines for providing scanning signals; a plurality of data lines for providing data signals; and a plurality of circuit of driving pixels, electrically connected to the scanning lines and the data lines. At least one of the circuit of driving pixel including any of the circuit of driving pixels described above in the exemplary arrangements. In a reset period, it is controlled to turn on a reset circuit 130 and a compensation circuit 140 and turn off a writing circuit 110, a first control circuit 120 and a second control circuit 150 by a first scanning signal, a light emitting control signal, a second scanning signal and a compensation control signal, to make a driving transistor DT in a bias state, therefore, an after-image phenomenon of a display image of an OLED display device may be improved, thus improving display quality. The display device may include any product or assembly having a display function, such as a mobile phone, a tablet computer, a television, a notebook computer, a digital photo frame, a navigator, and the like.

It should be understood that specific details of each circuit in the display device have been described in detail in corresponding circuit of driving pixel, and thus will not be elaborated here.

It should be noticed that, although several circuits or units of devices for action execution are mentioned in the detailed description above, such division is not mandatory. Indeed, according to arrangements of the present disclosure, the features and functions of two or more circuits or units described above may be embodied in one circuit or unit. Conversely, the features and functions of one of the circuits or units described above may be further divided into a plurality of circuits or units.

In addition, although various blocks of the methods in the present disclosure are described in a specific order in the accompanying drawings, this is not required or implied that the blocks must be performed in this specific order, or a desired result may be realized must by performing all the blocks shown. Additionally or alternatively, certain blocks may be omitted, a plurality of blocks may be combined into one block to execute, and/or one block may be decomposed into a plurality of blocks to execute, and the like.

Through the description of the above arrangements, those skilled in the art will readily understand that the exemplary arrangements described here may be implemented by software or by software in combination with necessary hardware. Therefore, the technical solution according to the arrangements of the present disclosure may be embodied in a form of software product, which may be stored in a non-volatile storage medium (which may be a CD-ROM, a USB flash drive, a mobile hard disk, etc.) or on a network, including a number of instructions to make a computing device (which may be a personal computer, a server, a mobile terminal, or a network device, etc.) to perform the methods according to arrangements in the present disclosure.

After considering the specification and practicing the disclosure herein, it will be easy for those skilled in the art to think of the other arrangement of the present disclosure. The present application intends to cover any variants, usage, or adaptation changes of the present disclosure. These variants, usage, or adaptation changes follow the general principle of the present disclosure, and include common sense or common technical means in the art not disclosed by the present disclosure. The specification and arrangement are only exemplary, and the real scope and spirit of the present disclosure are defined by the appended claims.

What is claimed is:

1. A circuit for driving a pixel, comprising:

a driving transistor having a first end connected to a first node, a control end connected to a second node, and a second end connected to a third node;

a writing circuit connected to a first scanning signal and the first node and configured to transmit a data signal to the first node;

a first control circuit connected to a light emitting control signal and configured to transmit a first voltage signal to the first node;

a reset circuit connected to a second scanning signal and configured to transmit a reference signal to the second node, wherein the first scanning signal is different from the second scanning signal, and a turning-on level of the second scanning signal is preceding to a turning-on level of the first scanning signal;

a compensation circuit connected to a compensation control signal and configured to put through a connection between the second end and the control end of the driving transistor in response to the compensation control signal, wherein the compensation control signal is different from the first scanning signal and the second scanning signal; wherein in a period, both the first scanning signal and the compensation control signal are at the turning-on level; in another period, the first scanning signal is at a turning-off level, and the compensation control signal is at the turning-on level;

a second control circuit connected to the light emitting control signal and configured to transmit a signal of the third node to a first end of a light emitting element, wherein a second end of the light emitting element is connected to a second voltage signal; and an energy storage circuit connected between a first power end and the second node.

2. The circuit for driving the pixel according to claim 1, further comprising:

an initialization circuit connected to a reference signal end and configured to initialize the first end of the light emitting element.

3. The circuit for driving the pixel according to claim 1, wherein:

the writing circuit comprises a first switching element having a control end connected to a first scanning end, a first end connected to a data signal end, and a second end connected to the first node;

the first control circuit comprises a second switching element having a control end connected to a light emitting control end, a first end connected to the first power end, and a second end connected to the first node;

the reset circuit comprises a third switching element having a control end connected to a second scanning end, a first end connected to a reference signal end, and a second end connected to the second node;

the compensation circuit comprises a fourth switching element having a control end connected to a compensation control signal end, a first end connected to the second end of the driving transistor, and a second end connected to the second node; and the second control circuit comprises a fifth switching element having a control end connected to the light emitting control end, a first end connected to the third node, and a second end connected to the first end of the light emitting element.

4. A method of driving a pixel applied to a circuit for driving the pixel, comprising:

providing a driving transistor having a first end connected to a first node, a control end connected to a second node, and a second end connected to a third node;

providing a writing circuit connected to a first scanning signal and the first node and configured to transmit a data signal to the first node;

providing a first control circuit connected to a light emitting control signal and configured to transmit a first voltage signal to the first node;

providing a reset circuit connected to a second scanning signal and configured to transmit a reference signal to the second node, wherein the first scanning signal is different from the second scanning signal, and a turning-on level of the second scanning signal is preceding to a turning-on level of the first scanning signal;

providing a compensation circuit connected to a compensation control signal and configured to put through a connection between the second end and the control end of the driving transistor in response to the compensation control signal, wherein the compensation control signal is different from the first scanning signal and the second scanning signal; wherein in a period, both the first scanning signal and the compensation control signal are at the turning-on level; in another period, the first scanning signal is at a turning-off level, and the compensation control signal is at the turning-on level;

providing a second control circuit connected to the light emitting control signal and configured to transmit a signal of the third node to a first end of a light emitting element, wherein a second end of the light emitting element is connected to a second voltage signal;

providing an energy storage circuit connected between a first power end and the second node;

controlling to turn on the reset circuit and the compensation circuit and turn off the writing circuit, the first control circuit, and the second control circuit, so as to make the driving transistor in a bias state;

controlling to turn on the writing circuit and the compensation circuit and turn off the first control circuit and the reset circuit, so as to write the data signal and a threshold voltage of the driving transistor to an energy storage circuit; and controlling to turn on the first control circuit and the second control circuit and turn off the writing circuit, the reset circuit, and the compensation circuit, so as to control the driving transistor to be turned on by the energy storage circuit to drive a light emitting element to emit light.

5. The method of driving pixel according to claim 4, further comprising turning on an initialization circuit, so as to initialize the first end of the light emitting element.

6. The method of driving pixel according to claim 4, wherein:

the writing circuit comprises a first switching element having a control end connected to a first scanning end, a first end connected to a data signal end, and a second end connected to the first node;

the first control circuit comprises a second switching element having a control end connected to a light emitting control end, a first end connected to the first power end, and a second end connected to the first node;

the reset circuit comprises a third switching element having a control end connected to a second scanning end, a first end connected to a reference signal end, and a second end connected to the second node;

the compensation circuit comprises a fourth switching element having a control end connected to a compensation control signal end, a first end connected to the second end of the driving transistor, and a second end connected to the second node; and the second control circuit comprises a fifth switching element, a control end connected to the light emitting control end, a first end connected to the third node, and a second end connected to the first end of the light emitting element, wherein the controlling to turn on the reset circuit and the compensation circuit and turn off the writing circuit, the first control circuit and the second control circuit, to make the driving transistor in the bias state, comprises:

the third switching element receiving the second scanning signal to turn on the third switching element, and transmitting the reference signal to the second node; and the fourth switching element receiving the compensation control signal to turn on the fourth switching element, and putting through the connection between the second end and the control end of the driving transistor; and the controlling to turn on the writing circuit and the compensation circuit and turn off the first control circuit, the reset circuit and the second control circuit, to write the data signal and the threshold voltage of the driving transistor to the energy storage circuit, comprises:

the first switching element receiving the first scanning signal to turn on the first switching element, and transmitting the data signal to the first node; turning on the driving transistor under control of the energy storage circuit; and the fourth switching element receiving the compensation control signal to be turned on to compensate the driving transistor.

7. The method of driving pixel according to claim 4, wherein:

the controlling to turn on the reset circuit and the compensation circuit and turn off the writing circuit, the first control circuit, and the second control circuit comprises making the driving transistor change to the bias state using the first scanning signal, the light emitting control signal, the second scanning signal, and the compensation control signal, and a potential of the control end of the driving transistor is Vint, a potential of the first end of the driving transistor becomes Vint minus Vth, and Vth is the threshold voltage of the driving transistor.

8. The method of driving pixel according to claim 4, wherein:

the controlling to turn on the writing circuit and the compensation circuit and turn off the first control circuit, the reset circuit, and the second control circuit comprises using the first scanning signal, the light emitting control signal, the second scanning signal, and the compensation control signal to write the data signal and the threshold voltage of the driving transistor to the energy storage circuit; and a potential of the first node is Vdata, and a potential of the second node is Vdata plus Vth, and Vth is the threshold voltage of the driving transistor.

9. A circuit for driving a pixel, comprising:

a driving transistor having a first end connected to a first node, a control end connected to a second node, and a second end connected to a third node;

a writing circuit connected to a first scanning signal and the first node and configured to transmit a data signal to the first node;

a first control circuit connected to a light emitting control signal and configured to transmit a first voltage signal to the first node;

a reset circuit connected to a second scanning signal and configured to transmit a reference signal to the second node, wherein the first scanning signal is different from the second scanning signal, and a turning-on level of the second scanning signal is preceding to a turning-on level of the first scanning signal;

a compensation circuit connected to a compensation control signal and configured to put through a connection between the second end and the control end of the driving transistor in response to the compensation control signal, wherein the compensation control signal is different from the first scanning signal and the second scanning signal; wherein in a first period, both the second scanning signal and the compensation control signal are at the turning-on level; in a second period, the second scanning signal is at a turning-off level, and the compensation control signal is at the turning-on level;

a second control circuit connected to the light emitting control signal and configured to transmit a signal of the third node to a first end of a light emitting element, wherein a second end of the light emitting element is connected to a second voltage signal; and an energy storage circuit connected between a first power end and the second node.

* * * * *